US005118324A

United States Patent [19]

Uchida

[11] Patent Number: 5,118,324

[45] Date of Patent: Jun. 2, 1992

[54] METHOD OF PRINTING CELLULOSE FIBER WITH REACTIVE DYE OR DIRECT DYE USING PASTE CONTAINING EMULSION OF HYDROPHOBIC COMPOUNDS

[75] Inventor: Juji Uchida, Sabae, Japan

[73] Assignee: Nicca Chemical Co., Ltd., Fukui, Japan

[21] Appl. No.: 613,548

[22] PCT Filed: Jul. 19, 1990

[86] PCT No.: PCT/JP89/00720

§ 371 Date: Nov. 19, 1990

§ 102(e) Date: Nov. 19, 1990

[87] PCT Pub. No.: WO91/01404

PCT Pub. Date: Feb. 7, 1991

[51] Int. Cl.[5] ..... D06P 3/60

[52] U.S. Cl. ..... 8/543; 8/552; 8/582; 8/611; 8/630; 8/918

[58] Field of Search ..... 8/543, 680

[56] References Cited

FOREIGN PATENT DOCUMENTS 53-058086 5/1978 Japan .

*Primary Examiner*—A. Lionel Clingman

*Attorney, Agent, or Firm*—McAulay Fisher Nissen Goldberg & Kiel

[57] ABSTRACT

Disclosed is a method of printing a cellulose fiber material with a reactive dye or direct dye, which comprises printing the cellulose fiber material with a printing paste containing an emulsion formed by emulsifying a mixture comprising a hydrophobic substance liquid at room temperature, represented by the following general formula I:

$$R_1O\left(\underset{\substack{|\\ R_3}}{CH}CH_2O\right)_l\left(\underset{\substack{|\\ R_4}}{CH}CH_2O\right)_mR_2 \qquad \text{I}$$

wherein $R_1$ and $R_2$ independently represent a hydrogen atom or an acyl group derived from a saturated or unsaturated monoaliphatic carboxylic acid having 2 to 22 carbon atoms, $R_3$ and $R_4$ independently represent a methyl group, an ethyl group or a phenyl group, and l and m represent zero or a positive integer, with the proviso that the sum of l and m is an integer of from 1 to 300 and when each of $R_1$ and $R_2$ is a hydrogen atom, the sum of l and m is an integer of from 6 to 300, and a hydrophobic substance solid at room temperature, represented by the following general formula II:

$$A(OR_5)_n \qquad \text{II}$$

wherein A represents a residue of a trihydric to hexahydric alcohol, $R_5$ represents an acyl group derived from a saturated or unsaturated fatty acid having 12 to 22 carbon atoms, and n is an integer of from 1 to 3, at a mixing weight ratio of from 5/95 to 95/5 with an emulsifier and water, and after drying or without drying, subjecting the fiber material to a fixing treatment.

11 Claims, No Drawings

METHOD OF PRINTING CELLULOSE FIBER WITH REACTIVE DYE OR DIRECT DYE USING PASTE CONTAINING EMULSION OF HYDROPHOBIC COMPOUNDS

DESCRIPTION

1. Technical Field

The present invention relates to a method of printing a cellulose fiber. More particularly, the present invention relates to a method of printing a cellulose fiber, in which environmental pollution by exhaust gas and waste water is fully controlled at the step of printing a cellulose fiber, and a printed product having a high quality can be provided.

2. Background Art

When printing cellulose fibers, in general, a half-emulsion paste obtained by mixing a water-swollen product of at least one member selected from the group consisting of sodium alginate, carboxymethyl cellulose (CMC) and carboxymethyl starch (processed starch) with an emulsion paste formed by emulsifying a mineral oil such as kerosene or mineral turpentine and water with a nonionic or anionic surface active agent is used as the thickener. A printing color paste is formed by adding a dye, 50 to 200 parts of urea, 20 to 30 parts of an alkaline agent such sodium carbonate or sodium bicarbonate, a reduction-preventing agent, and water to 500 to 600 parts of the above-mentioned half-emulsion paste. A reactive dye or a direct dye is generally used as the dye. In general, the viscosity of the color paste is 2,000 to 50,000 cp, as measured at 12 rpm by using a rotary viscometer supplied by Tokyo Keiki Kabushiki Kaisha. This color paste is applied to a fabric by manual printing or by a roller printing machine, a flat printing machine, a rotary printing machine or the like, the paste-applied fabric is dried or is not dried, and is subjected to a dye-fixing treatment such as a dry heat treatment or a steam heat (steaming) treatment, the fabric is subjected to a soaping treatment to remove the unfixed dye, the paste, and other unnecessary substances adhering to the fabric, and finally, the fabric is subjected to a finish treatment such as a drying treatment or a feel-adjusting treatment.

The mineral turpentine emulsion is incorporated into the thickener for the following reasons. The flowability close to the Newtonian flowability, which is attained when sodium alginate alone is used, is made almost equal to the plastic flowability by the incorporation of the mineral turpentine emulsion, whereby the screen permeability of the color paste at the printing step is improved. Furthermore, the coloring property of the dye and the color sharpness are improved by the incorporation of the mineral turpentine emulsion. Moreover, where a reactive dye is used, by controlling the reaction between the paste and the dye, the desizing property (which has a significant influence on the touch and fastness characteristics of the finished product) at the soaping step is improved.

The above-mentioned method using an emulsion of a mineral oil such as mineral turpentine is unsatisfactory in that, since the mineral oil used in the emulsion has an offensive smell and is inflammable, problems arise in connection with operation safety and sanitation. Moreover, air pollution is caused by exhaust gas at the drying step after the printing operation, the mineral oil is incorporated into waste water at the step of washing the screen or printing device or from the remaining color paste, an ingress of the smell to private houses surrounding the printing factory is caused by warm waste water, and an environmental pollution of rivers, which is a serious social problem, occurs.

The inventors investigated the foregoing problems caused by the mineral oil emulsion used in printing factories, and proposed a successful technique applicable to an emulsion paste for printing a polyester fiber, in Japanese Examined Patent Publication No. 58-7757. Nevertheless, when this technique is used in the method of printing a cellulose fiber, in which the mineral oil emulsion is used in a largest quantity, although the problem of environmental pollution can be solved, the printing quality such as the coloring property is unsatisfactory, and accordingly, this technique cannot be directly applied to the printing of a cellulose fiber. It is considered that the reason for this is that the properties of the fibers are very different; for example, the polyester fiber is hydrophobic but the cellulose fiber is hydrophilic.

DISCLOSURE OF THE INVENTION

The inventors then investigated the problems arising in the printing of a cellulose fiber, and as a result, completed the present invention. An object of the present invention is to provide a printed product having a superior coloring property, pattern sharpness, and desizing property, compared to a printed product obtained by using a half-emulsion paste comprising a mineral oil such as mineral turpentine, to thereby solve the problems of the operation sanitation and safety and the problems of environmental pollution by exhaust gas and waste water.

In accordance with the present invention, there is provided a method of printing a cellulose fiber material with a reactive dye or direct dye, which comprises printing the cellulose fiber material with a printing paste containing an emulsion formed by emulsifying a mixture comprising a hydrophobic substance liquid at room temperature, represented by the following general formula I:

$$R_1O\left(\underset{\substack{|\\ R_3}}{CH}CH_2O\right)_l\left(\underset{\substack{|\\ R_4}}{CH}CH_2O\right)_m R_2 \qquad \text{I}$$

wherein $R_1$ and $R_2$ independently represent a hydrogen atom or an acryl group derived from a saturated or unsaturated monoaliphatic carboxylic acid having 2 to 22 carbon atoms, $R_3$ and $R_4$ independently represent a methyl group, an ethyl group or a phenyl group, and l and m represent zero or a positive integer, with the proviso that the sum of l and m is an integer of from 1 to 300 and when each of $R_1$ and $R_2$ is a hydrogen atom, the sum of l and m is an integer of from 6 to 300, and a hydrophobic substance solid at room temperature, represented by the following general formula II:

$$A(OR_5)_n \qquad \text{II}$$

wherein A represents a residue of a trihydric to hexahydric alcohol, $R_5$ represents an acyl group derived from a saturated or unsaturated fatty acid having 12 to 22 carbon atoms, and n is an integer of from 1 to 3, at a mixing weight ratio of from 5/95 to 95/5 with an emulsifier and water, and after drying or without drying, subjecting the fiber material to a fixing treatment.

BEST MODE OF CARRYING OUT THE INVENTION

The present invention will now be described in detail. The emulsion formed by emulsifying a mixture of the hydrophobic substance liquid at room temperature, represented by the general formula I, and the hydrophobic substance solid at room temperature, represented by the general formula II, is incorporated as the thickener into a color paste, whereby the intended effect is attained.

If one of the compounds represented by the general formulae I and II alone is emulsified, this effect is not attained. The reason for this is considered to be as follows. Namely, in the case of a color paste comprising a paste such as sodium alginate alone in the thickener, it is considered that, at the stage of printing the printing color paste and drying the color paste-applied fabric, the paste forms a continuous filmy solid coating on the fiber. Accordingly, for the dye to be absorbed in the fiber, at the fixing treatment, the dye must pass through this dry coating and arrive at the surface of the fiber. This problem is especially serious in the dry heat fixing method, and in practice, although a large quantity of an assistant having a large dye-dissolving power or a high moisture-absorbing property, such as urea, is used, only an insufficient dye absorption is obtained. In the steam fixing method, it may be considered that the paste coating will be easily swollen by steam, but in practice, the steaming time is about 7 to about 8 minutes, and this time is too short to achieve a swelling of the paste covering or absorption of the dye. If the half-emulsion thickener comprising an emulsion of a mineral oil such as mineral turpentine is used, the mineral oil is evaporated at the drying step while leaving fine pores (microvoid structure) in the paste coating, and it is considered that these fine pores promote a migration of the dye or swelling of the paste at the fixing step.

When one of the compounds of the general formulae I and II alone is emulsified, no substantial improvement is attained over the case where a thickener composed solely of sodium alginate is used. If a mixture of the compounds of the general formulae I and II is emulsified, the coloring property is greatly improved. The reason for this is considered to be that the solid hydrophobic substance exerts a function of inhibiting the formation of a continuous coating of a paste, and the liquid hydrophobic substance contributes to an increase of the swelling speed of the paste and the moving speed of the dye at the fixing treatment. Namely, when a mixture of the liquid and solid hydrophobic substances is emulsified, a discontinuous film of another paste/liquid substance/solid substance is formed instead of the microvoid structure formed in the dry coating when the mineral turpentine emulsion is used, and it is considered that this discontinuous coating facilitates the fixation of the dye.

As the compound of the general formula I used as the first component of the paste in the present invention, there can be mentioned polyoxypropylene glycol, polyoxybutylene glycol, polyoxystyrene glycol, a propylene oxide/butylene oxide copolymer, a propylene/styrene oxide copolymer and mono- and di-esters thereof with saturated and unsaturated aliphatic carboxylic acids having 2 to 22 carbon atoms. These compounds can be used alone or in the form of mixtures of two or more thereof.

In the compound of the general formula II used as the second component of the paste in the present invention, as the trihydric to hexahydric alcohol constituting A, there can be mentioned trihydric alcohols such as glycerol-, trimethylolpropane, trihydroxyisobutane, 1,2,3-pentatriol, 2,3,4-pentatriol and trihydroxyethyl isocyanurate, tetrahydric alcohols such as diglycerol and pentaerythritol, pentahydric alcohols such as adonitol, D-arabitol and xylitol, and hexahydric alcohols such as D-sorbitol, D-mannitol and dipentaerythritol. Among these alcohols, glycerol, diglycerol, pentaeryt-hritol, D-sorbitol and dipentaerythritol are preferred. As the saturated or unsaturated fatty acid having 12 to 22 carbon atoms for introducing the acyl group $R^5$, there can be mentioned -lauric acid, myristic acid, palmitic acid, stearic acid, oleic acid, linoleic acid and linolenic acid. These acids are used alone, or in the form of a mixture of two or more thereof, as the second component.

The first and second components are present in the emulsion in a total amount of 10 to 70% by weight, preferably 20 to 40% by weight.

A surface active agent customarily used for emulsifying hydrophobic substances can be used as the emulsifier. For example, an appropriate emulsifier is selected from anionic activators such as a sulfuric acid ester of a higher alcohol, a sulfuric acid ester of an ethylene oxide adduct of a higher alcohol, and a highly sulfated oil, and nonionic activators such as an ethylene oxide adduct of a higher alcohol, an ethylene oxide/propylene oxide adduct of a higher alcohol, an ethylene oxide adduct of an alkylphenol, an ethylene oxide/propylene oxide adduct of an alkylphenol, fatty acid esters and dissocyanate reaction products thereof, and a fatty acid ester of polyethylene glycol.

When the above-mentioned emulsion is used, there is advantageously adopted a method in which the emulsion is premixed with a water-swollen product of a paste such as sodium alginate, CMC or processed starch, and the mixture is used as the thickener for a color paste. Alternately, the emulsion can be directly added when the color paste is prepared. Preferably, the emulsion is used in an amount of 10 to 50% by weight in the color paste.

Reactive dyes and direct dyes customarily used for printing cellulose fibers can be used as the dye. When the above-mentioned emulsion is used for printing a mix-spun product, a disperse dye, a cationic dye or an acidic dye can be used in combination. Furthermore, customarily used agents such as a moisture-absorbing agent, a dye-dissolving agent, a pH adjusting agent, a defoaming agent, and a reduction-preventing agent can be incorporated into the color paste.

The color paste comprising the valuable emulsion of the present invention is printed on a knitted or woven fabric of a cellulose fiber by the manual printing operation or by using a roller printing machine, a rotary printing machine or a flat screen printing machine, and after drying or without drying, the color paste-printed fabric is subjected to a fixing treatment such as a steaming treatment, a dry heat fixing treatment, or an alkali shock treatment. Then the unfixed dye, the paste and other unnecessary substances adhering to the fabric are removed by a washing (soaping) treatment, and a finishing treatment such as a drying treatment or a touch-adjusting treatment is carried out.

According to the method of the present invention for printing a cellulose fiber, a dye coloring property, a pattern edge sharpness, and a desizing effect comparable to those attained when a color paste containing an emulsion formed by emulsifying 30 to 70% by weight of a mineral oil such as mineral turpentine and 70 to 30% by weight of water with 1 to 5% by weight of an emulsifier is used can be obtained. Furthermore, since a mineral oil is not incorporated, the problems of operation sanitation and safety, and the problems of environmental pollution by exhaust gas and waste water, can be completely solved.

The present invention will now be described in detail with reference to the following examples. In the examples, all of "%" and "parts" are by weight.

EXAMPLES 1 THROUGH 17

A compound of the general formula I, shown in Table 1, a compound of the general formula II, shown in Table 2, and an emulsifier were weighed and charged in a stainless steel vessel, the mixture was heated and melted at 70 to 80° C, and hot water was gradually added to the mixture with stirring by a homomixer. Then the mixture was cooled and the temperature lowered to 30° C, whereby the preparation of an emulsion was completed.

The volatility was evaluated by charging 10 g of the compound in a Petri dish, treating the compound at 170° C. in a drier (a perfect oven supplied by Tabai) for 1 minute and calculating the residual ratio according to the following formula:

$$\text{Residual ratio (\%)} = \frac{\text{residual amount (g)}}{10\text{ (g)}} \times 100$$

The composition of the emulsion is shown in Table 3.

TABLE 1

| Compound of General Formula I | | | |
|---|---|---|---|
| Compound | Structure | Properties | Volatility (residual ratio, %) |
| a | polypropylene glycol ($R_1$, $R_2$ = H; $R_3$, $R_4$ = $CH_3$; l + m = 69 in general formula I) | colorless transparent liquid | 100 |
| b | polybutylene glycol ($R_1$, $R_2$ = H; $R_3$, $R_4$ = $C_2H_5$; l + m = 28 in general formula) | colorless transparent liquid | 100 |

TABLE 1-continued

| Compound of General Formula I | | | |
|---|---|---|---|
| Compound | Structure | Properties | Volatility (residual ratio, %) |
| c | dipropylene glycol dicaprate ($R_1$, $R_2$ = $C_9H_{19}CO$; $R_3$, $R_4$ = $CH_3$; l + m = 2 in general formula I) | light-yellow transparent liquid | 99 |
| d | polypropylene glycol diacetate ($R_1$, $R_2$ = $CH_3CO$; $R_3$, $R_4$ = $CH_3$; l + m = 7 in general formula I) | light-yellow transparent liquid | 99 |
| e | polypropylene glycol dilaurate ($R_1$, $R_2$ = $C_{11}H_{23}CO$; $R_3$, $R_4$ = $CH_3$; l + m = 7 in general formula I) | light-yellow transparent liquid | 100 |
| f | polypropylene glycol dioleate ($R_1$, $R_2$ = $C_{17}H_{33}CO$; $R_3$, $R_4$ = $CH_3$; l + m = 7 in general formula I) | light-yellow transparent liquid | 100 |
| g | polypropylene glycol distearate ($R_1$, $R_2$ = $C_{17}H_{35}CO$; $R_3$, $R_4$ = $CH_3$; l + m = 34 in general formula I) | light-yellow transparent liquid | 100 |

TABLE 2

| Compound of General Formula II | | | |
|---|---|---|---|
| Compound | Structure | Properties | Volatility (residual ratio, %) |
| h | glycerol monostearate (A = glycerol; $R_5$ = $C_{17}H_{35}CO$; n = 1 in general formula II) | light-yellow solid, melting point of 40° C. | 100 |
| i | pentaerythritol dioleate (A = pentaerythritol; $R_5$ = $C_{17}H_{33}CO$; n = 2 in general formula II) | light-yellow solid, melting point of 45° C. | 100 |
| j | pentaerythritol distearate (A = pentaerythritol; $R_5$ = $C_{17}H_{35}CO$; n = 2 in general formula II) | light-yellow solid, melting point of 75° C. | 100 |
| k | dipentaerythritol dioleate (A = dipentaerythritol; $R_5$ = $C_{17}H_{33}CO$; n = 2 in general formula II) | light-brown solid, melting point of 45° C. | 100 |
| o | sorbitol monomyristate (A = sorbitol; $R_5$ = $C_{13}H_{27}CO$; n = 1 in general formula II) | light-brown solid, melting point of 62° C. | 100 |
| p | sorbitol tristearate (A = sorbitol; $R_5$ = $C_{17}H_{35}CO$; n = 2 in general formula II) | light-yellow solid, melting point of 65° C. | 100 |
| q | trihydroxyethylisocyanuryl distearate (A = trihydroxyisocyanuryl distearate; $R_5$ = $C_{17}H_{35}CO$; n = 2 in general formula II) | light-yellow solid, melting point of 75° C. | 100 |

TABLE 3

| Composition of Emulsion | | | | |
|---|---|---|---|---|
| | Emulsion Composition (parts) | | | |
| Emulsion No. | compound of general formula I | compound of general formula II | emulsifier | water |
| 1 | (a) 150 | (h) 150 | (r) 50 | 650 |
| 2 | (a) 150 | (i) 150 | (r) 50 | 650 |
| 3 | (a) 150 | (j) 150 | (r) 50 | 650 |
| 4 | (a) 150 | (k) 150 | (r) 50 | 650 |
| 5 | (a) 150 | (o) 150 | (r) 50 | 650 |
| 6 | (a) 150 | (p) 150 | (r) 50 | 650 |
| 7 | (a) 100 | (q) 200 | (r) 50 | 650 |
| 8 | (b) 100 | (k) 200 | (r) 50 | 650 |

TABLE 3-continued

| Emulsion No. | Composition of Emulsion: Emulsion Composition (parts) compound of general formula I | compound of general formula II | emulsifier | water |
|---|---|---|---|---|
| 9 | (c) 100 | (k) 200 | (r) 50 | 650 |
| 10 | (d) 100 | (k) 200 | (r) 50 | 650 |
| 11 | (e) 100 | (q) 200 | (r) 50 | 650 |
| 12 | (f) 100 | (k) 200 | (r) 50 | 650 |
| 13 | (g) 100 | (k) 200 | (r) 50 | 650 |
| 14 | (a) 300 | 0 | (r) 50 | 650 |
| 15 | 0 | (k) 300 | (r) 50 | 650 |

The composition of the emulsifier (r) mentioned in Table 3 was as follows:

| | |
|---|---|
| 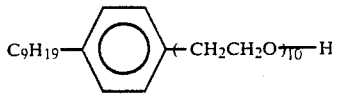 | 400 parts |
| $C_{18}H_{33}COO(CH_2CH_2O)_{20}OC.C_{18}H_{33}$ | 600 parts |
| Total | 1000 parts |

Each of the emulsions shown in Table 3 was a white pasty composition having a viscosity of 2,000 to 40,000 cp (as measured at 12 rpm by a BM type viscometer supplied by Tokyo Keiki).

For comparison, a mineral turpentine emulsion having the following composition was prepared by using a homomixer:

| | |
|---|---|
| ST-50A (emulsifier supplied by Nikka Kagaku) | 50 parts |
| Water | 350 parts |
| Mineral turpentine | 600 parts |
| Total | 1000 parts |

A scoured bleached cotton broadcloth was printed in polka dots with a color paste containing the emulsion shown in Table 3, by using an experimental automatic screen printing machine (supplied by Tsujii Senki Kogyo), and the broadcloth was dried at 100° C. for 2 minutes and subjected to a sticking treatment at 103° C. for 7 minutes by a high-temperature (HT) steamer (supplied by Tsujii Senki Kogyo). The composition of the color paste was as follows:

| | |
|---|---|
| 6% Water-swollen product of Snow Algin M (supplied by Fuji Kagaku) | 300 parts |
| Emulsion shown in Table 3 | 200 parts |
| C.I. Reactive Blue 15 | 30 parts |
| Sodium bicarbonate | 30 parts |
| Urea | 50 parts |
| RSK Powder (reduction-preventing agent supplied by Showa Kako) | 3 parts |
| Water | 387 parts |
| Total | 1000 parts |

After the fixing treatment, the printed fabric was washed with water subjected to a soaping treatment at a bath ratio of 1/30 and a temperature of 90° C. for 10 minutes, using 2 g/l of a soaping agent (Lipotol RK-5 supplied by Nikka Kagaku), and then the fabric was washed with water and dried.

For comparison, a color paste having the same composition as described above, except that the above-mentioned mineral turpentine emulsion was used as the emulsion, and a color paste having the same composition as described above except that no emulsion was used but the amount of the sodium alginate thickener was increased to 400 parts, were prepared, and printed fabrics were obtained in the same manner as described above by using these color pastes.

The dye absorption density of the printed portion of each printed fabric, determined based on the surface optical density of the printed fabric obtained by using the color paste not containing the mineral turpentine emulsion, which is regarded as being 100, is shown in Table 4. Furthermore, the sharpness of the pattern edge evaluated by the visual judgement and the softness (touch) of the printed portion evaluated by the tactual sense are shown in Table 4.

TABLE 4

| Example No. | Dye Absorption Density, Sharpness and Softness (Touch) of Printed Fabric: Emulsion Used for Color Paste | Dye Absorption Density | Sharpness | Touch |
|---|---|---|---|---|
| 1 | No. 1 | 105 | ○ | ◎ |
| 2 | No. 2 | 105 | ○ | ◎ |
| 3 | No. 3 | 109 | ○ | ◎ |
| 4 | No. 4 | 108 | ○ | ◎ |
| 5 | No. 5 | 105 | ○ | ◎ |
| 6 | No. 6 | 108 | ○ | ◎ |
| 7 | No. 7 | 108 | ○–◎ | ◎ |
| 8 | No. 8 | 108 | ○–◎ | ◎ |
| 9 | No. 9 | 110 | ◎ | ◎ |
| 10 | No. 10 | 115 | ○–◎ | ◎ |
| 11 | No. 11 | 111 | ◎ | ◎ |
| 12 | No. 12 | 110 | ◎ | ◎ |
| 13 | No. 13 | 113 | ◎ | ◎ |
| 14 | No. 14 (comparison) | 81 | x | x |
| 15 | No. 15 (comparison) | 70 | ○ | ○ |
| 16 | turpentine emulsion (comparison) | 105 | Δ | x |
| 17 | no emulsion (comparison) | 100 | x | x |

Note
◎: superior
○: excellent
Δ: usable
x: not usable

In the color pastes comprising the emulsions of the present invention, the smell was much less than in the color paste comprising the turpentine emulsion of Example 16 (comparison), the coloring property (dye absorption density) was comparable or superior to that attained in Examples 14, 15, 16 and 17, and the sharpness and touch were good. Generally speaking, the printed products obtained according to the method of the present invention were faultless, and superior to the printed products obtained according to the conventional methods.

EXAMPLES 18 THROUGH 20

A scoured polynosic rayon woven fabric was printed in a floral pattern with a color paste containing emulsion No. 9 shown in Table 3 by using a Tsjuii type automatic screen printing machine, dried at 100° C. for 2 minutes and subjected to a fixing treatment at 103° C. for 7 minutes by using an HT steamer. After the fixing treatment, the printed fabric was washed with water, subjected to a soaping treatment at a bath ratio of 1/30 and a temperature of 90° C. for 10 minutes by using 2 g/l of a soaping agent (Lipotol RK-5), washed with water, and dried.

The composition of the color paste was as shown below:

| | |
|---|---|
| Snow Algin M (6%) | 300 parts |
| Emulsion No. 9 shown in Table 3 | 200 parts |
| C.I. Reactive Black 5 | 80 parts |
| Sodium bicarbonate | 30 parts |
| Urea | 150 parts |
| RSK Powder | 5 parts |
| Water | 235 parts |
| Total | 1000 parts |

For comparison, a color paste having the same composition as described above, except that the above-mentioned mineral turpentine emulsion was used as the emulsion, and a color paste having he same composition as described above except that no emulsion was used but the amount of the sodium alginate thickener was increased to 400 parts, were prepared and the above-mentioned treatments were carried out in the same manner by using these color pastes.

The results are shown in Table 5.

TABLE 5

Results of Printing of Polynosic Rayon Woven Fabric

| Example No. | Emulsion Used for Color Paste | Dye Absorption Density | Sharpness | Touch |
|---|---|---|---|---|
| 18 | No. 9 | 110 | ⊚ | ⊚ |
| 19 | turpentine emulsion | 103 | Δ | Δ |
| 20 | no emulsion | 100 | x | x |

According to the method of the present invention, a printed product having a superior dye absorption density, sharpness, and touch was obtained.

EXAMPLES 21 THROUGH 23

A scoured cotton broadcloth was printed in a floral pattern with a color paste containing emulsion No. 9 shown in Table 3 by using a Tsujii type automatic screen printing machine, dried at 100° C. for 2 minutes, and subjected to a fixing treatment at 103° C. for 60 minutes by an HT steamer. After the filing treatment, the printed fabric was washed with water, subjected to a soaping treatment at a bath ratio of 1/30 and a temperature of 60° C. for 10 minutes by using a soaping agent (Sunmorl 120 supplied by Nikka Kagaku), washed with water, and dried.

The composition of the color paste was as follows:

| | |
|---|---|
| Snow Algin M (6%) | 300 parts |
| Emulsion No. 9 shown in Table 3 | 200 parts |
| C.I. Direct Blue 202 | 30 parts |
| Dyegent DH (dye-dissolving agent supplied by Nikka Kagaku) | 30 parts |
| Sodium carbonate | 10 parts |
| Urea | 50 parts |
| RSK Powder | 5 parts |
| Secondary sodium phosphate | 10 parts |
| Water | 365 parts |
| Total | 1000 parts |

For comparison, a color paste having the same composition as described above, except that the above-mentioned mineral turpentine emulsion was used as the emulsion, and a color paste having the same composition as described above except that no emulsion was used but the amount of the sodium alginate thickener was increased to 400 parts, were prepared and the above-mentioned treatments were carried out in the same manner by using these color pastes.

The results are shown in Table 6.

TABLE 6

Results of Printing of Cotton Broadcloth

| Example No. | Emulsion Used for Color Paste | Dye Absorption Density | Sharpness | Touch |
|---|---|---|---|---|
| 21 | No. 9 | 103 | ⊚ | ⊚ |
| 22 | turpentine emulsion | 102 | ⊚ | Δ |
| 23 | no emulsion | 100 | ○ | Δ |

According to the method of the present invention, a printed product having a superior dye absorption density, sharpness, and touch was obtained.

Industrial Applicability

The present invention can be utilized for the production of a high-grade cellulose fiber printed product, and environmental pollution can be drastically reduced.

I claim:

1. A method of printing a cellulose fiber material with a reactive dye or direct dye, which comprises printing the cellulose fiber material with a printing paste containing an emulsion formed by emulsifying a mixture comprising a hydrophobic substance liquid at room temperature, represented by the following general formula I:

$$R_1O\left(\underset{\underset{R_3}{|}}{CH}CH_2O\right)_l\left(\underset{\underset{R_4}{|}}{CH}CH_2O\right)_m R_2 \qquad \text{I}$$

wherein $R_1$ and $R_2$ independently represent a hydrogen atom or an acyl group derived from a saturated or unsaturated monoaliphatic carboxylic acid having 2 to 22 carbon atoms, $R_3$ and $R_4$ independently represent a methyl group, an ethyl group or a phenyl group, and l and m represent zero or a positive integer, with the proviso that the sum of l and m is an integer of from 1 to 300 and when each of $R_1$ and $R_2$ is a hydrogen atom, the sum of l and m is an integer of from 6 to 300, and a hydrophobic substance solid at room temperature, represented by the following general formula II:

$$A(OR_5)_n \qquad \text{II}$$

wherein A represents a residue of a trihydric to hexahydric alcohol, $R_5$ represents an acyl group derived from a saturated or unsaturated fatty acid having 12 to 22 carbon atoms, and n is an integer of from 1 to 3, at a mixing weight ratio of from 5/95 to 95/5 with an emulsifier and water, and after drying or without drying, subjecting the fiber material to a fixing treatment.

2. A method according to claim 1, wherein the substance represented by the general formula I is a member selected from the group consisting of polyoxypropylene glycol, polyoxybutylene glycol, polyoxystyrene glycol, propylene oxide/butylene oxide copolymers, propylene oxide/styrene oxide copolymers, and mono- and diesters thereof with saturated and unsaturated aliphatic carboxylic acids having 2 to 22 carbon atoms.

3. A method according to claim 1, wherein A in the general formula II is a member selected from the group consisting of residues of glycerol, trimethylolpropane, trihydroxyisobutane, 1,2,3-pentatriol, 2,3,4-pentatriol, trihydroxyethyl isocyanurate, diglycerol, pentaerythritol, adonitol, D-arabitol, xylitol, D-sorbitol, D-mannitol and dipentaerythritol.

4. A method according to claim 1, wherein R in the general formula II is an acyl group derived from lauric acid, myristic acid, palmitic acid, stearic acid, oleic acid, linoleic acid and lionolenic acid.

5. A method according to claim 1, wherein the component represented by the general formula I and the component represented by the general formula II are present in the emulsion in a total amount of 10 to 70% by weight.

6. A method according to claim 5, wherein said amount is 20 to 40% by weight.

7. A method according to claim 1, wherein the emulsifier is a member selected from the group consisting of anionic activators such as sulfuric acid esters of higher alcohols, sulfuric acid esters of ethylene oxide adducts of higher alcohols and highly sulfated oils, and nonionic activators such as ethylene oxide adducts of higher alcohols, ethylene oxide/propylene oxide adducts of higher alcohols, ethylene oxide adducts of alkylphenols, ethylene oxide/propylene oxide adducts of alkylphenols, fatty acid esters and diisocyanate reaction products thereof, and fatty acid esters of polyethylene glycol.

8. A method according to claim 1, wherein in the printing paste, sodium alginate, carboxymethyl cellulose or processed starch is used in combination with the emulsion.

9. A method according to claim 1, wherein the emulsion is present in the printing paste in an amount of 10 to 50% by weight.

10. A method according to claim 1, wherein the printing paste is printed on the fiber material by the manual printing operation or by using a roller printing machine, a rotary printing machine or a flat screen printing machine.

11. A method according to claim 1, wherein the fixing treatment is carried out according to a steaming method, a heat dry fixing method or an alkali shock method.

* * * * *